US005776037A

United States Patent [19]

Millington

[11] Patent Number: 5,776,037

[45] Date of Patent: Jul. 7, 1998

[54] ISOMETRIC EXERCISE DEVICE

[76] Inventor: Donald B. Millington, 97 Paddock Ave., Meriden, Conn. 06450

[21] Appl. No.: 797,870

[22] Filed: Feb. 10, 1997

[51] Int. Cl.[6] ..... A63B 21/002

[52] U.S. Cl. ..... 482/91; 482/38; 482/142

[58] Field of Search ..... 482/38–42, 91, 482/104, 142, 907

[56] References Cited

U.S. PATENT DOCUMENTS

D. 191,690 10/1961 Ryan ..... 482/142 X 5,538,487 7/1996 Fulmer ..... 482/91 X

*Primary Examiner*—Richard J. Apley
*Assistant Examiner*—John Mulcahy
*Attorney, Agent, or Firm*—Michael I. Kroll

[57] ABSTRACT

An isometric exercise device (10) which comprises a flat bench (12) and an upright rack (14). A pair of butterfly arms (44) are held in either an upright position or an outwardly angular position on opposite sides of the base (30) of the upright rack. A person without strength and endurance can exercise isometrically all parts of the body with the flat bench (12), with the upright rack (14) and with a combination of the flat bench (12) and the upright rack (14) together.

16 Claims, 2 Drawing Sheets

24
16
18
28
10
12
22
20
18
26
26

14
10
42
32
34
32
38

34
44
20
44
40
62
36
40
44
40
44
3
46
36
30
40
46

ISOMETRIC EXERCISE DEVICE

BACKGROUND OF THE INVENTION

1. Field of the Invention

The instant invention relates generally to bodybuilding equipment and more specifically it relates to an isometric exercise device. The isometric exercise device is an adjustable bench with an upright rack that will allow a person having physical impairment to exercise isometrically with less effort and stress.

2. Description of the Prior Art

Weight lifting is a sports activity that may have any of several objectives. Weight lifting may be done competitively as a test of strength or as bodybuilding to increase muscle mass and definition. Many people also engage in weight lifting as part of an exercise regimen using it to build strength and stamina or as a part of physical therapy to speed recovery from an illness.

Weight lifting for physical conditioning is more properly called weight training. In addition to barbells and dumbbells, the equipment used in weight training may include a variety of other resistance devices, such as Nautilus machines. Many athletes, including football and baseball players, swimmers, bicyclists, golfers and runners, engage in weight training to build their basic strength and to promote physical fitness. Physicians often prescribe supervised weight training as a means of regaining strength and coordination after an illness or injury.

Bodybuilding is a special branch of weight training that emphasizes symmetrical, balanced, and clearly defined muscular development. Specially devised exercises using dumbbells, barbells, and other types of equipment make it possible for the bodybuilder to exercise each part of the body and to develop muscle mass and definition to a remarkable extent. Bodybuilders engage in competitions where the judging is based on which contestant has the most impressive appearance rather than which is actually strongest.

Numerous bodybuilding equipment have been provided in prior art that are adapted to enhance muscle tone and coordination and the development of the body, especially the physique through exercise. While these units may be suitable for the particular purpose to which they address, they would not be as suitable for the purposes of the present invention as heretofore described.

SUMMARY OF THE INVENTION

A primary object of the present invention is to provide an isometric exercise device that will overcome the shortcomings of the prior art devices.

Another object is to provide an isometric exercise device that will allow a person without strength or endurance to exercise isometrically all parts of the body as opposed to using free weights, exhausting calisthenics, aerobics, etc.

An additional object is to provide an isometric exercise device that is composed of two components being a flat bench with an adjustable inclining backrest that can be used in conjunction with an upright rack, for the person to exercise isometrically thereon.

A further object is to provide an isometric exercise device that is simple and easy to use.

A still further object is to provide an isometric exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
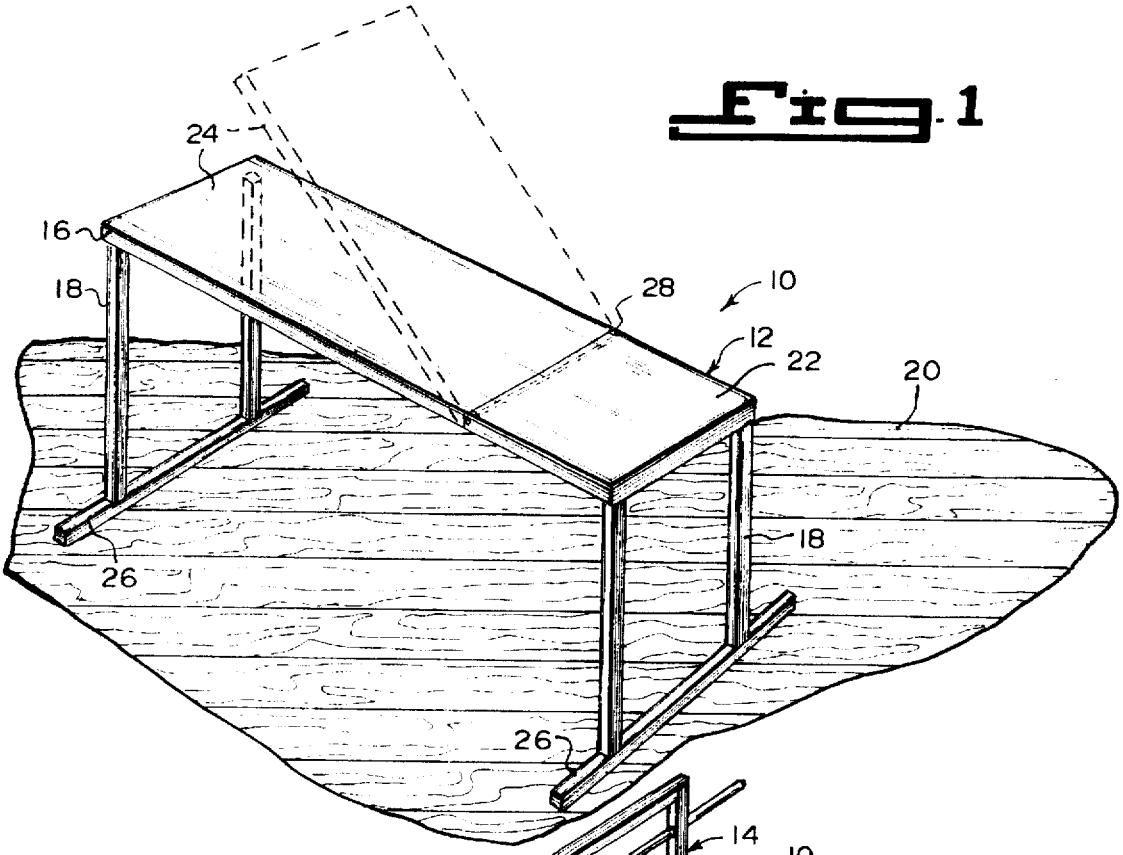
FIG. 1 is a perspective view of the flat bench showing movement of the backrest in dotted lines.
Figure 2:
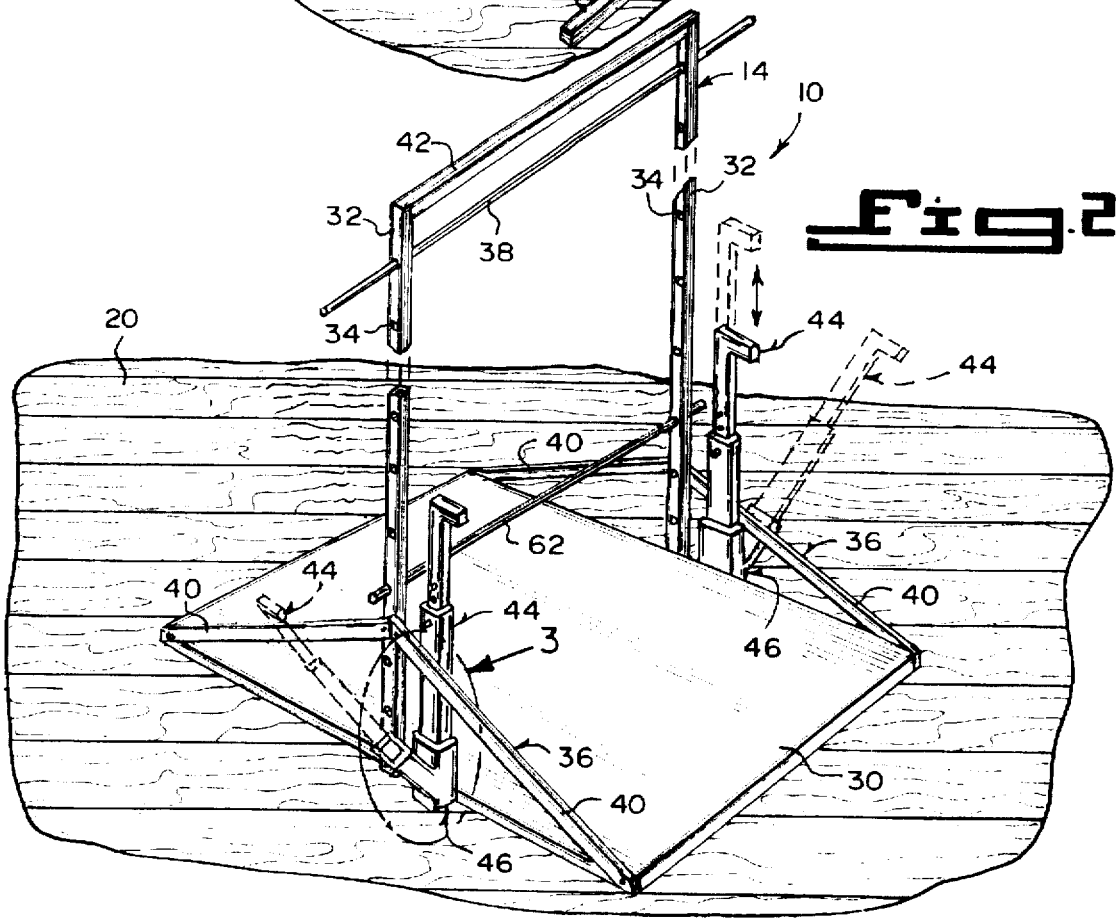
FIG. 2 is a perspective view of the upright rack with parts broken away.

Turning now descriptively to the drawings, in which similar reference characters denote similar elements throughout the several views, FIGS. 1 through 5 illustrate an isometric exercise device 10 which comprises a flat bench 12 and an upright rack 14. A person without strength and endurance can exercise isometrically all parts of the body with the flat bench 12, with the upright rack 14 and with a combination of the flat bench 12 and the upright rack 14 together.

Figure 5:
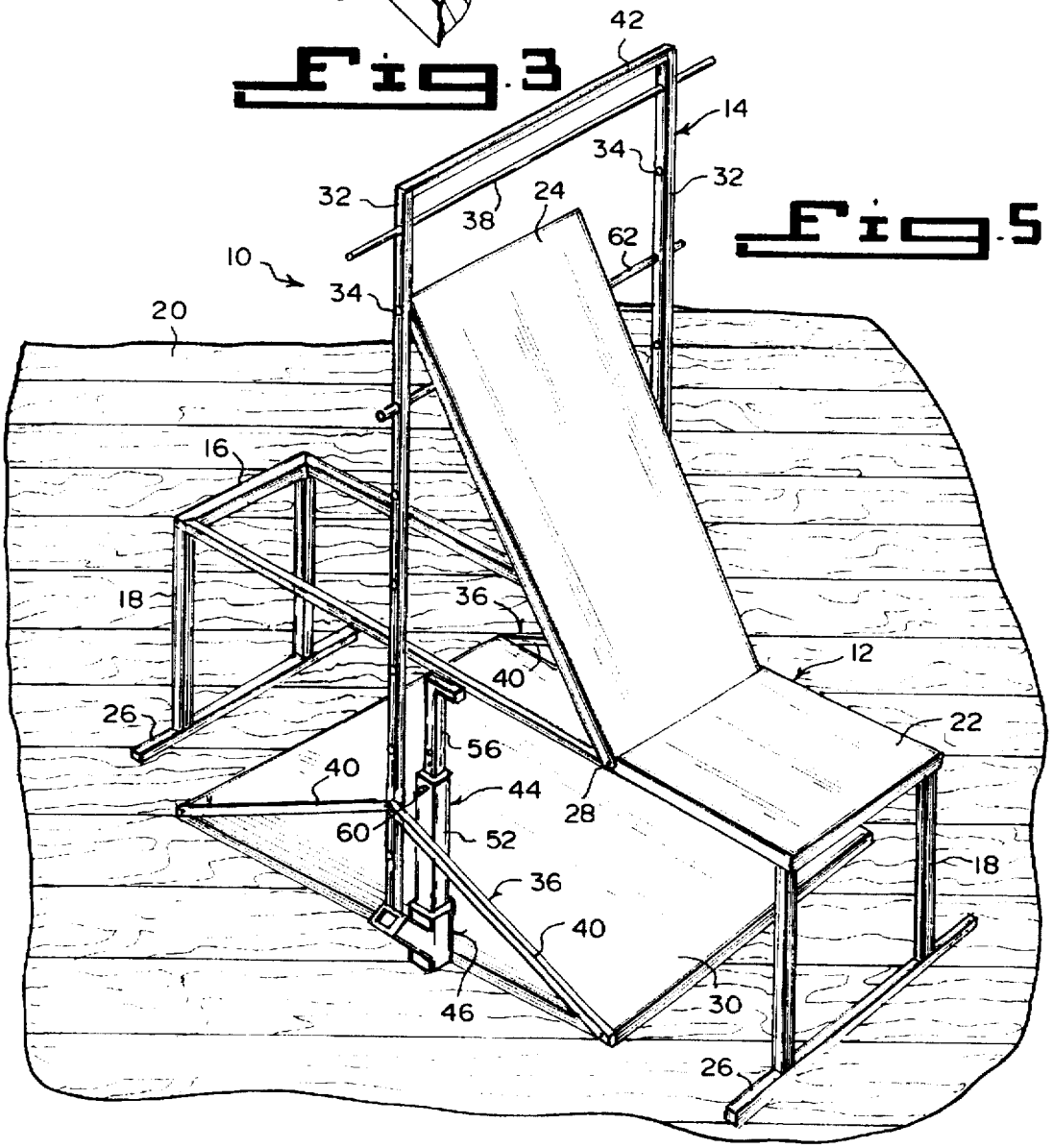
FIG. 5 is a perspective view showing the flat bench being used in conjunction with the upright rack.

The flat bench 12, as shown in FIGS. 1 and 5, include a rectangular frame 16. Four legs 18 are provided. Each leg 18 extends downwardly from a corner of the rectangular frame 16, to support the rectangular frame 16 above a floor 20. A seat 22 is attached to a first end of the rectangular frame 16. A backrest 24 is carried on a second end of the rectangular frame 16 adjacent the seat 22, so that the person can use the flat bench 12 to exercise isometrically.

The flat bench 12 further includes two cross foot bars 26. Each cross foot bar 26 is affixed to and extends horizontally between bottom ends of two legs 18, parallel to and below a short side of the rectangular frame 16 for stabilizing the legs 18 upon the floor 20. A hinge 28 is between abutting ends of the seat 22 and the backrest 24, so that the backrest 24 can be inclined in an adjustable manner.

The upright rack 14, as shown in FIGS. 2 through 5, consists of a base plate 30 to sit upon the floor 20. A pair of elongated standards 32 are provided. Each elongated standard 32 has a plurality of evenly spaced apart adjustment holes 34 therethrough. A structure 36 is for attaching in an upright position each elongated standard 32 to an opposite side of the base plate 30, so that the adjustment holes 34 in the elongated standards 32 are in alignment. An adjustable exercise bar 38 fits into any two aligned adjustment holes 34 in the elongated standards 32. The adjustable exercise bar 38 can extend horizontally across the elongated standards 32 above the base plate 30, to allow the person to grip the adjustable exercise bar 38 and exercise isometrically.

Each attaching structure 36 includes a pair of brace members 40. Each brace member 40 is connected to and extends at an angle from a side corner of the base plate 30 to a lower portion of the elongated standard 32, so as to maintain the elongated standard 32 in the upright position.

A crossbar 42 is affixed at opposite ends to upper ends of the elongated standards 32. The crossbar 42 will extend horizontally above the base plate 30, to stabilize the elongated standards 32 in their upright positions.

A pair of butterfly arms 44 are also provided. Components 46 are for holding in an upright position and an outwardly angular position each butterfly arm 44 to an opposite side of the base plate 30, so that the person can grip the butterfly arms 44 to exercise isometrically.

Figure 3:
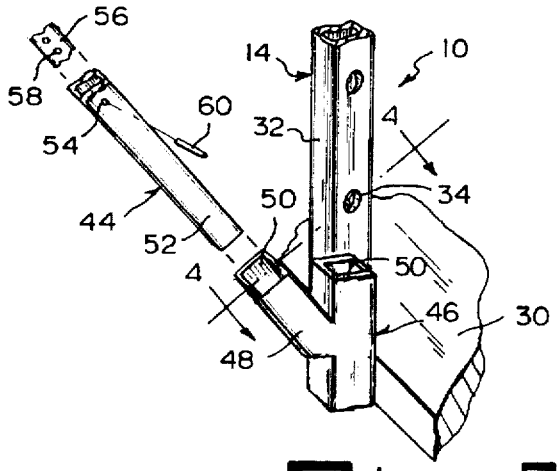
FIG. 3 is an enlarged perspective view of an area indicated by arrow 3 in FIG. 2.
Figure 4:
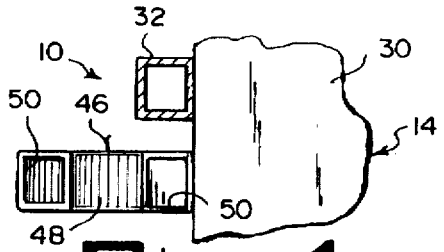
FIG. 4 is a cross sectional view taken along line 4—4 in FIG. 3.

Each holding component 46, as best seen in FIGS. 3 and 4, is a Y-shaped bracket 48 having two sockets 50 therein. The Y-shaped bracket 48 is mounted to the side of the base plate 30 adjacent one elongated standard 32, so that a lower end of the butterfly arm 44 can be plugged into any one socket 50 of the Y-shaped bracket 48.

Each butterfly arm 4 is height adjustable and includes a sleeve segment 52 having a transverse aperture 54 therethrough. A rod segment 56 has a plurality of spaced apart transverse apertures 58 therethrough, whereby the rod segment 56 is sized to slide within the sleeve segment 52. A pin 60 is to be inserted into the transverse aperture 54 in the sleeve segment 52 and one of the transverse apertures 58 in the rod segment 56.

An adjustable back support bar 62 fits into any two aligned adjustment holes 34 in the elongated standards 32. The adjustable back support bar 62 can extend horizontally across the elongated standards 32 above the base plate 30, to maintain the adjustable backrest 24 on the flat bench 12 in an inclined manner, when the flat bench 12 is placed in conjunction with the upright rack 14. This allows the person to use the flat bench 12 and the upright rack 14 together to exercise isometrically.

LIST OF REFERENCE NUMBERS

10 isometric exercise device
12 flat bench of 10
14 upright rack of 10
16 rectangular frame of 12
18 leg of 12
20 floor
22 seat of 12
24 backrest of 12
26 cross foot bar of 12
28 hinge between 22 and 24
30 base plate of 14
32 elongated standard of 14
34 adjustment hole in 32
36 attaching structure for 32 of 14
38 adjustable exercise bar of 14
40 brace member of 36
42 crossbar of 14
44 butterfly arm of 14
46 holding component for 44 of 14
48 Y-shaped bracket
50 socket in 48
52 sleeve segment of 44
54 transverse aperture in 52
56 rod segment of 44
58 transverse aperture in 56
60 pin in 54 and 58
62 adjustable back support bar of 14

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. An isometric exercise device, which comprises: an upright rack which includes:

a) a base plate to sit upon the floor;

b) a pair of elongated standards, each said elongated standard having a plurality of evenly spaced apart adjustment holes therethrough;

c) means for attaching in an upright position each said elongated standard to an opposite side of said base plate, so that said adjustment holes in said elongated standards are in alignment;

d) an adjustable exercise bar to fit into any two aligned adjustment holes in said elongated standards, so that said adjustable exercise bar can extend horizontally across said elongated standards above said base plate, to allow a person to grip said adjustable exercise bar and exercise isometrically;

e) a pair of butterfly arms; and f) means for holding in an upright position and an outwardly angular position each said butterfly arm to an opposite side of said base plate, so that a person can grip said butterfly arms to exercise isometrically.

2. An isometric exercise device as recited in claim 1, wherein each of said attaching means includes a pair of brace members, in which each said brace member is connected to and extends at an angle from a side corner of said base plate to a lower portion of said elongated standard, so as to maintain said elongated standard in the upright position.

3. An isometric exercise device as recited in claim 1, further including a crossbar affixed at opposite ends to upper ends of said elongated standards, so that said crossbar will extend horizontally above said base plate to stabilize said elongated standards in their upright positions.

4. An isometric exercise device as recited in claim 1, wherein each said holding means is a Y-shaped bracket having two sockets therein, said Y-shaped bracket mounted to the side of said base plate adjacent one said elongated standard, so that a lower end of said butterfly arm can be plugged into any one socket of said Y-shaped bracket.

5. An isometric exercise device as recited in claim 1, wherein each said butterfly arm is height adjustable and includes:

a) a sleeve segment having a transverse aperture therethrough;

b) a rod segment having a plurality of spaced apart transverse apertures therethrough, whereby said rod segment is sized to slide within said sleeve segment; and c) a pin to be inserted into said transverse aperture in said sleeve segment and one of said transverse apertures in said rod segment.

6. An isometric exercise device as recited in claim 1, further including a flat bench and an adjustable back support bar to fit into any two aligned adjustment holes in said elongated standards, so that said adjustable back support bar can extend horizontally across said elongated standards above said base plate, to maintain an adjustable backrest on said flat bench in an inclined manner when said flat bench is placed in conjunction with said upright rack, thereby allowing the person to use said flat bench and said upright rack together to exercise isometrically.

7. An isometric exercise device as recited in claim 6, wherein said flat bench includes:

a) a rectangular frame;

b) four legs, in which each said leg extends downwardly from a corner of said rectangular frame to support said rectangular frame above a floor;

c) a seat attached to a first end of said rectangular frame; and d) said adjustable backrest carried on a second end of said rectangular frame adjacent said seat, so that the person can use said flat bench to exercise isometrically.

8. An isometric exercise device as recited in claim 7, wherein said flat bench further includes two cross foot bars, in which each said cross foot bar is affixed to and extends horizontally between bottom ends of two said legs, parallel to and below a short side of said rectangular frame for stabilizing said legs upon the floor.

9. An isometric exercise device as recited in claim 7, wherein said flat bench further includes a hinge between abutting ends of said seat and said backrest, so that said backrest can be inclined in an adjustable manner.

10. An isometric exercise device which comprises:

a) a flat bench, wherein said flat bench includes a rectangular frame, four legs, in which each of said legs extends downwards from a corner of said rectangular frame to support said rectangular frame above a floor, a seat attached to a first end of said rectangular frame and an adjustable backrest carried on a second end of said rectangular frame adjacent said seat, so that a person can use said flat bench to exercise isometrically, and b) an upright rack, wherein said upright rack includes a base plate to sit upon the floor, a pair of elongated standards, each said elongated standard having a plurality of evenly spaced apart adjustment holes therethrough, means for attaching in an upright position each said elongated standard to an opposite side of said base plate so that said adjustment holes in said elongated standards are in alignment, an adjustment exercise bar to fit into any two aligned adjustment holes in said elongated standard so that said adjustable exercise bar can extend horizontally across said elongated standards above said base plate, a pair of butterfly arms and means for holding in an upright position and an outwardly angular position each said butterfly arm to an opposite side of said base plate so that a person can grip said butterfly arms to exercise isometrically, and an adjustable back support bar to fit into any two aligned adjustment holes in said elongate standards so that said adjustable back support bar can extend horizontally across said elongated standards above said base plate to maintain said adjustable backrest on said flat bench in an inclined manner when said flat bench is placed in conjunction with said upright rack, to allow a person to grip said adjustable exercise bar and exercise isometrically all parts of the body with said flat bench, with said upright rack and with a combination of said flat bench and said upright rack together.

11. An isometric exercise device as recited in claim 10, wherein said flat bench further includes two cross foot bars, in which each said cross foot bar is affixed to and extends horizontally between bottom ends of two said legs, parallel to and below a short side of said rectangular frame for stabilizing said legs upon the floor.

12. An isometric exercise device as recited in claim 11, wherein said flat bench further includes a hinge between abutting ends of said seat and said backrest, so that said backrest can be inclined in an adjustable manner.

13. An isometric exercise device as recited in claim 12, wherein each of said attaching means includes a pair of brace members, in which each said brace member is connected to and extends at an angle from a side corner of said base plate to a lower portion of said elongated standard, so as to maintain said elongated standard in the upright position.

14. An isometric exercise device as recited in claim 13, further including a crossbar affixed at opposite ends to upper ends of said elongated standards, so that said crossbar will extend horizontally above said base plate to stabilize said elongated standards in their upright positions.

15. An isometric exercise device as recited in claim 10, wherein each said holding means is a Y-shaped bracket having two sockets therein, said Y-shaped bracket mounted to the side of said base plate adjacent one said elongated standard, so that a lower end of said butterfly arm can be plugged into any one socket of said Y-shaped bracket.

16. An isometric exercise device as recited in 15, wherein each said butterfly arm is height adjustable and includes:

a) a sleeve segment having a transverse aperture therethrough;

b) a rod segment having a plurality of spaced apart transverse apertures therethrough, whereby said rod segment is sized to slide within said sleeve segment; and c) a pin to be inserted into said transverse aperture in said sleeve segment and one of said transverse apertures in said rod segment.

* * * * *